US006546880B2

(12) United States Patent
Agee

(10) Patent No.: US 6,546,880 B2
(45) Date of Patent: Apr. 15, 2003

(54) HEIGHT ADJUSTABLE TABLE

(75) Inventor: William Michael Agee, Huntersville, NC (US)

(73) Assignee: Baker Manufacturing Company, Pineville, LA (US)

( * ) Notice: Subject to any disclaimer, the term of this patent is extended or adjusted under 35 U.S.C. 154(b) by 0 days.

(21) Appl. No.: 09/768,934

(22) Filed: Jan. 23, 2001

(65) Prior Publication Data

US 2001/0037751 A1 Nov. 8, 2001

Related U.S. Application Data

(63) Continuation-in-part of application No. 09/328,817, filed on Jun. 9, 1999, now abandoned.

(51) Int. Cl.[7] ..... A47B 9/00
(52) U.S. Cl. ..... 108/147; 248/188.2
(58) Field of Search ..... 108/147, 144.1, 108/147.11, 147.19; 248/188.7, 188.4, 186.5

(56) References Cited

U.S. PATENT DOCUMENTS

| | | | | |
|---|---|---|---|---|
| 544,836 | A | | 8/1895 | Vetter |
| 2,982,050 | A | | 5/1961 | May |
| 3,140,559 | A | | 7/1964 | Grow et al. |
| 3,213,809 | A | | 10/1965 | Kritske |
| 3,273,517 | A | | 9/1966 | Amthor, Jr. |
| 3,364,881 | A | | 1/1968 | Kooi |
| 3,638,584 | A | | 2/1972 | Cisler |
| 3,908,560 | A | | 9/1975 | Horner |
| 4,130,069 | A | | 12/1978 | Evans et al. |
| 4,360,180 | A | | 11/1982 | Bruneau |
| 4,619,208 | A | | 10/1986 | Kurrasch |
| 4,751,884 | A | | 6/1988 | Ball |
| 4,981,085 | A | | 1/1991 | Watt |
| 5,289,782 | A | | 3/1994 | Rizzi et al. |
| 5,322,025 | A | | 6/1994 | Sherman et al. |
| 5,339,750 | A | | 8/1994 | Smies |
| 5,370,063 | A | * | 12/1994 | Childers ..... 108/147 |
| 5,400,721 | A | | 3/1995 | Green |
| 5,408,940 | A | | 4/1995 | Winchell |
| 5,598,788 | A | | 2/1997 | Jonker |
| 5,601,037 | A | * | 2/1997 | Meyer et al. ..... 108/147 |
| 5,706,739 | A | * | 1/1998 | Shaheen et al. ..... 108/147 |
| 5,797,331 | A | | 8/1998 | Watt |
| 5,819,669 | A | * | 10/1998 | Eyre ..... 108/147 |
| 5,845,590 | A | * | 12/1998 | Seidl ..... 108/147 |
| 5,941,182 | A | * | 8/1999 | Greene ..... 108/147 |
| 6,026,755 | A | * | 2/2000 | Long ..... 108/147 |
| 6,062,148 | A | * | 5/2000 | Hodge et al. ..... 108/147 |
| 6,119,605 | A | * | 9/2000 | Agee ..... 108/147 |

* cited by examiner

*Primary Examiner*—Jose V. Chen
(74) *Attorney, Agent, or Firm*—Garvey, Smith, Nehrbass & Doody, LLC; Charles C. Garvey, Jr.

(57) ABSTRACT

An adjustable height table has a frame with spaced apart side portions spanned by a horizontal tray with a knee area below the tray. Each side has a foot that engages the floor or like support surface. Each side includes a lower non-elevating base part and an upper elevating "lift" part. The non-elevating and elevating portions each have an outer wall, a hollow interior and vertical slots that face in opposite respective directions for a given side (including a non-elevating portion and an elevating lift portion). A gear mechanism interfaces the upper "lift" and lower "base" parts. When the table is in an extremely elevated position, roller supports minimize lateral translation. The roller supports fit shaped rails on the elevating parts. The frame can receive any of three selected mechanisms. Each mechanism features a horizontal shaft contained within the tray. The mechanism includes a counterbalance spring that can be used to counterbalance loads of different amounts such as when different objects are supported by the table work surface, a motor drive that changes elevation using electrical power, and a manually operable crank mechanism.

27 Claims, 13 Drawing Sheets

HEIGHT ADJUSTABLE TABLE

CROSS-REFERENCE TO RELATED APPLICATIONS

This is a continuation-in-part of U.S. patent application Ser. No. 09/328,817, filed Jun. 9, 1999 now abandoned, which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to adjustable tables, more particularly, tables having a work surface that can carry heavy objects and yet be adjusted into multiple elevational positions. Even more particularly, the present invention relates to an improved height adjustable table having an improved roller guide and lift arrangement that accepts multiple actuator mechanisms and that minimizes lateral deflection of the work surface when it is in a elevated position and even when supporting weighted objects such as computers, monitors and the like.

2. General Background of the Invention

Adjustable tables have been in use for many years. There are several adjustable height tables that are commercially available. Several of these adjustable height tables were patented as drafting tables. Several of these patented, commercially available tables were sold under the trademark Hamilton®.

One of the primary uses for adjustable height tables is the support of a heavy object such as a computer and/or monitor at a comfortable elevation for the user. Because computers and monitors are relatively heavy, a problem exists when the table is at a maximum elevational position such as when the user chooses to stand. In such a situation, adjustable height tables can become top heavy and suffer from lateral instability. The weighted table top of the table tends to deflect when it is elevated to a high position and when it is loaded with a heavy object such as a monitor, computer or the like.

Many patents have issued that are directed to elevating or height adjustable tables. Examples include the Hamilton® drafting tables that were sold for many years (eg. see U.S. Pat. Nos. 3,140,559 and 3,273,517).

Early patents that show adjustable height tables/shelves are shown for example in U.S. Pat. Nos. 544,836; 1,243,750; 2,532,342; and 2,604,996.

The May Patent discloses an adjustable support for a drafting table. In the May U.S. Pat. No. 2,982,050, an adjustable drafting board support that includes a pair of links that swing to elevate and lower the board and an improved arrangement for counterbalancing the board to apply a substantially uniform lift to the board in all operative positions. The Grow U.S. Pat. No. 3,140,559 discloses a drafting table that uses a rack and pinion arrangement in combination with a locking or braking mechanism which is adapted to lock the vertically adjustable table in any selected position when the operating linkage has been released and which lock will become even more securely locked upon the application of downward pressure on the table top occurring in normal use.

The Kooi U.S. Pat. No. 3,364,881 discloses a drafting table with a single pedal control of both vertical movement and tilting.

The Kritske U.S. Pat. No. 3,213,809 discloses an adjustable table and brake mechanism therefore.

U.S. Pat. No. 3,638,584 discloses a drafting table that includes a pedestal, support columns associated with the pedestal for vertical movement and a drafting board on an upper portion thereof. An elevating table is disclosed in the Feiertag U.S. Pat. No. 3,820,176.

A telescoping support arm of quadrangular cross-section is disclosed in the Bertalot U.S. Pat. No. 3,887,115. The apparatus provides roller bearings in corner spaces between each tube surrounding each other, the rollers in one corner rolling over separate braces supported on resilient means urging the rollers and the inner tube toward the other corner so as to exclude backlash.

The Horner U.S. Pat. No. 3,908,560 discloses a counter balancing system for a drafting table.

A vertically adjustable drafting table is disclosed in the Evans U.S. Pat. No. 4,130,069.

The Raymond U.S. Pat. No. 4,469,029 discloses a workstation comprised of support legs with a stable support base and the uprights on which pivoting elbows are adapted to form adjacent arms which are positioned and locked in place in an adjustable angular manner at one of these end of the arms, the other end bearing supports are work tops positioned and locked in place in a manner which can be angularly adjusted at will, so that these supports or work tops allow effects and uses which are multiple and can be combined together.

U.S. Pat. No. 4,591,214 issued to Reuter discloses a cabinet closure assembly that includes a panel which is pivotable between opening-blocking and opening-unblocking positions. The Kurrasch U.S. Pat. No. 4,619,208 discloses a work surface height adjustment mechanism.

An adjustable computer work table is disclosed in U.S. Pat. No. 4,637,322. Vertically actuating scissor arms are provided for moving the support shaft upward and downward whereby providing a vertical adjustment.

The Ball U.S. Pat. No. 4,751,884 discloses a height adjustable work top. The work top is adjustable and may tilt about a horizontal axis near the front edge. The work top may be mounted in an open office beam system or an office screen or partition in cantilever fashion or it may be a free standing unit.

A table lift mechanism is disclosed in the Watt U.S. Pat. No. 4,981,085. The '085 Patent discloses furniture having a top or the like supported for vertical movement by telescoping legs supports with a counter balance for exerting a relatively uniform counter balance force from the top throughout its range of vertical movement. A latch mechanism is provided for latching the top in the selected vertical positions, and an adjustable roller guide mechanism as provided for coupling the telescoping elements of the legs supports.

An apparatus for adjusting a computer work station to individual needs is disclosed in the Seiler U.S. Pat. No. 5,041,770.

An adjustable height table is disclosed in the Rizzi U.S. Pat. No. 5,289,782. The '782 Patent discloses a table having a top that can be vertically adjusted to various heights by a pair of telescoping legs and a counter balance weight mechanism which includes a weight box and weights that can be easily added or removed by the user depending on the weight carried by the table top. A locking mechanism including a spring urged threaded half nut and a stationary threaded rod enables the table top to be locked in place once a desired height is achieved.

An adjustable dual work surface support is disclosed in the Sherman, et al, U.S. Pat. No. 5,332,025. The Borgman, et al, U.S. Pat. No. 5,323,695 discloses a method of using a work station having separate and back tops having separate power drive arrangements while permitting independent height adjustment. A controller, which is programed by an operator, permits storage of a number of predetermined height locations each defining distinct heights for the tops. The operator effects programed movement of the tops to predetermined height locations for predetermined times in a predetermined sequence, with the rear top moving initially and a front top moving thereafter.

The Smies U.S. Pat. No. 5,339,750 discloses an adjustable work table. The '750 Patent table comprises a base and at least one movable extensible vertical column attached to the base having a table top carried on the vertical column. A pivot is provided for moving the table top into any of a range of pivoted positions, preferably on both sides of the horizontal position of the table top. A motor is provided for holding the table top in any of the range of pivoted positions.

A non-binding cantilevered table lifting device disclosed in the Childers U.S. Pat. No. 5,370,063.

The Winchell U.S. Pat. No. 5,408,940 discloses an adjustable height work surface with rack and pinion arrangements.

Recently issued patents that are owned by Baker Manufacturing Company of Pineville, LA (assignee herein) are directed to adjustable height tables having various mechanisms. These include U.S. Pat. No. 5,752,448 entitled "Motorized Table"; U.S. Pat. No. 5,578,799 entitled "Computer Work Station" U.S. Pat. No. 5,685,231 entitled "Computer Work Station" and U.S. Pat. No. 5,819,669 entitled "Motorized Console.

BRIEF SUMMARY OF THE INVENTION

The present invention provides an adjustable height table that has a base that includes spaced apart sides and a horizontally extending cross piece. The sides include non-elevating parts that carry lifts that move up and down. A planar work table with a work surface can be mounted horizontally across the lifts.

A gear train enables the upper and lower parts to telescope, one part elevating with respect to the other. The gear train can include a rack and pinion gear arrangement and a counterbalance spring that enables the table to carry different objects that vary in weight.

A plurality of guide wheels are mounted within each side portion.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
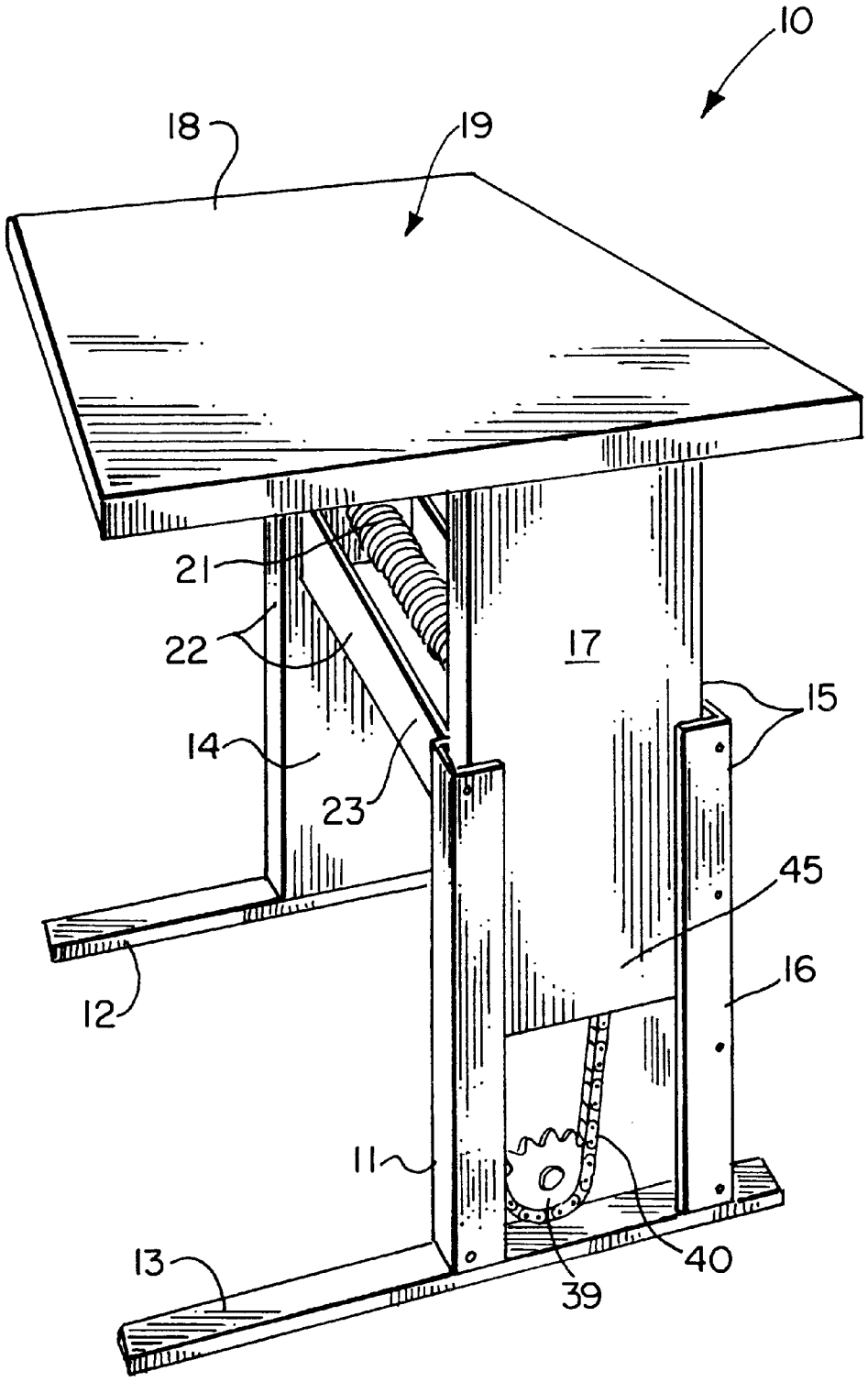
FIG. 1 is a perspective view of the preferred embodiment of the apparatus of the present invention, equipped with a counterbalance spring mechanism.
Figure 2:
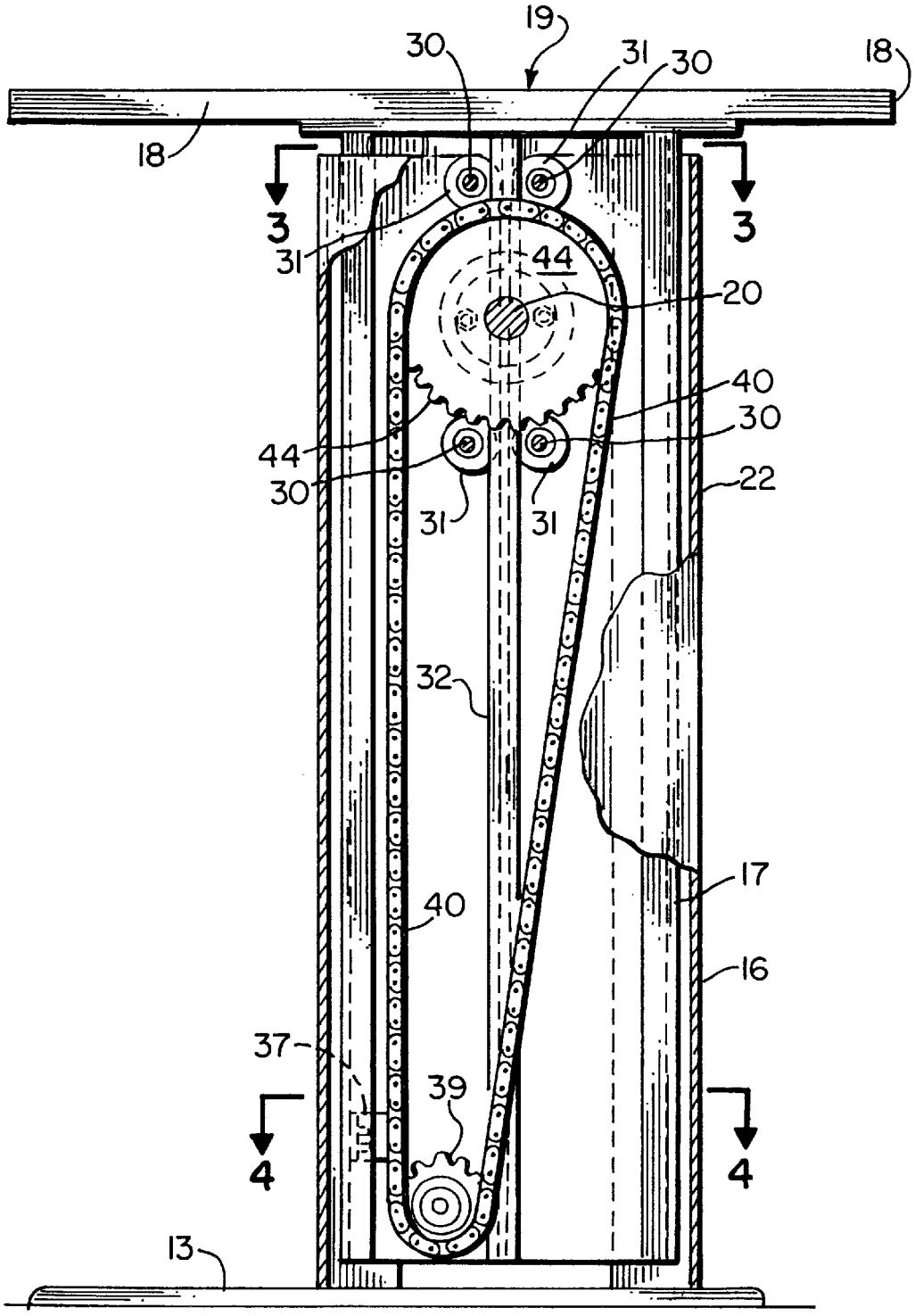
FIG. 2 a side elevation view of the preferred embodiment of the apparatus of the present invention.

FIGS. 1–5 show generally the preferred embodiment of the apparatus of the present invention designated by the numeral 10, in FIG. 1. Adjustable height table 10 includes a frame 22 (see FIG. 5) that is comprised of spaced apart sides 14, 15 connected by a horizontal tray member 23 and supported by feet 12,13. An open area below tray 23 and in between sides 14, 15 is a knee space that enables a user to sit at table 10 and place his or her knees under horizontal member 23, the knee area designated by the numeral 91 in FIG. 5.

Each side 14, 15, includes a lower part 16 that is a fixed part of an overall fixed base 11 that accepts a selected mechanism from a plurality of available mechanisms. Base 11 thus includes lower parts 16 and horizontal tray member 23 to which feet 12, 13 can be attached (removably, such as bolted or permanently, such as welded). Lower part 16 of base 11 telescopingly receives an upper elevating part or lift 17 as more particularly shown in FIGS. 1–3 and 5.

Figure 8:
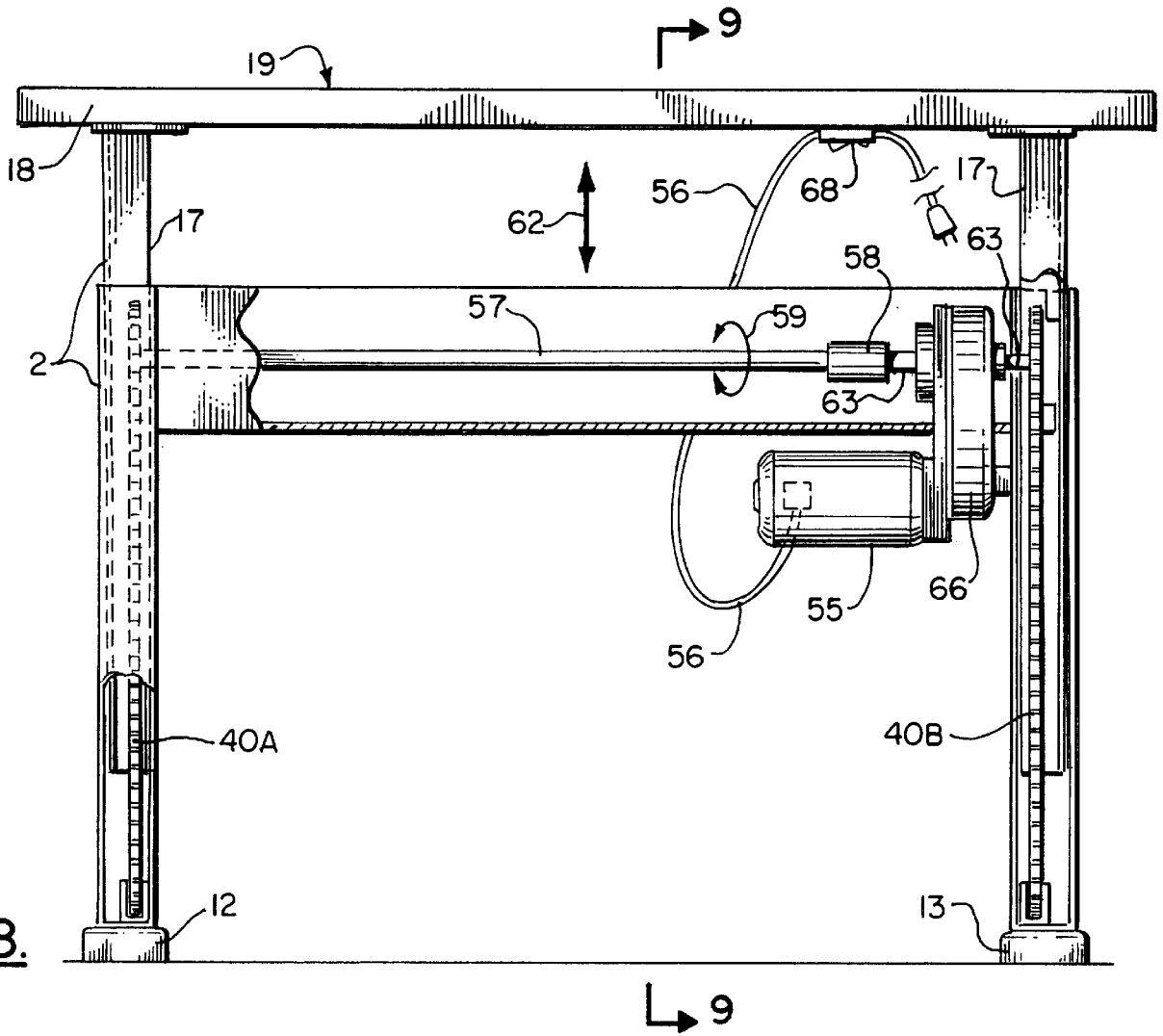
FIG. 8 is a front view of the preferred embodiment of the apparatus of the present invention equipped with electric motor drive.
Figure 9:
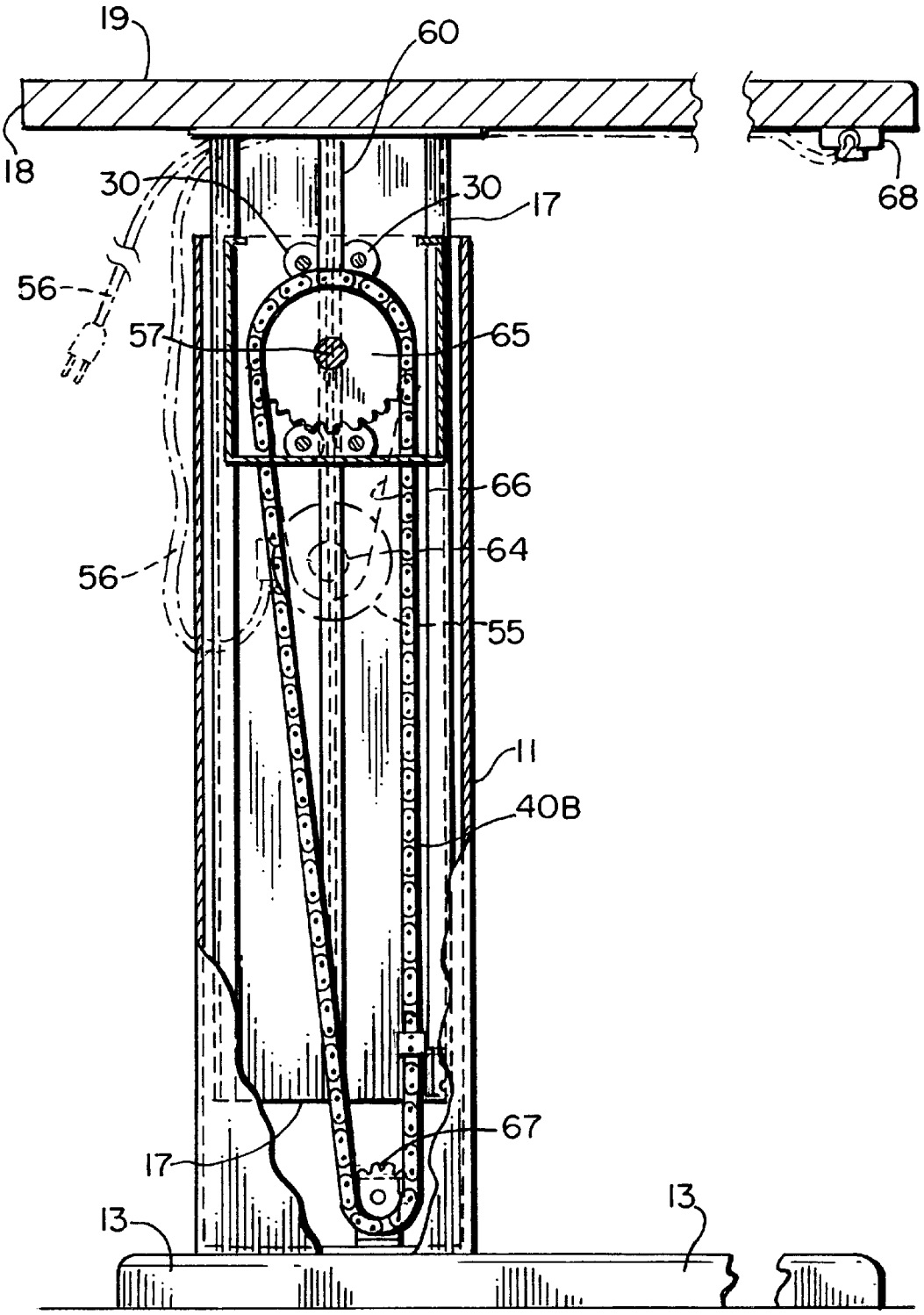
FIG. 9 is a sectional view of the preferred embodiment of the apparatus of the present invention taken along lines 9—9 of FIG. 5.
Figure 10:
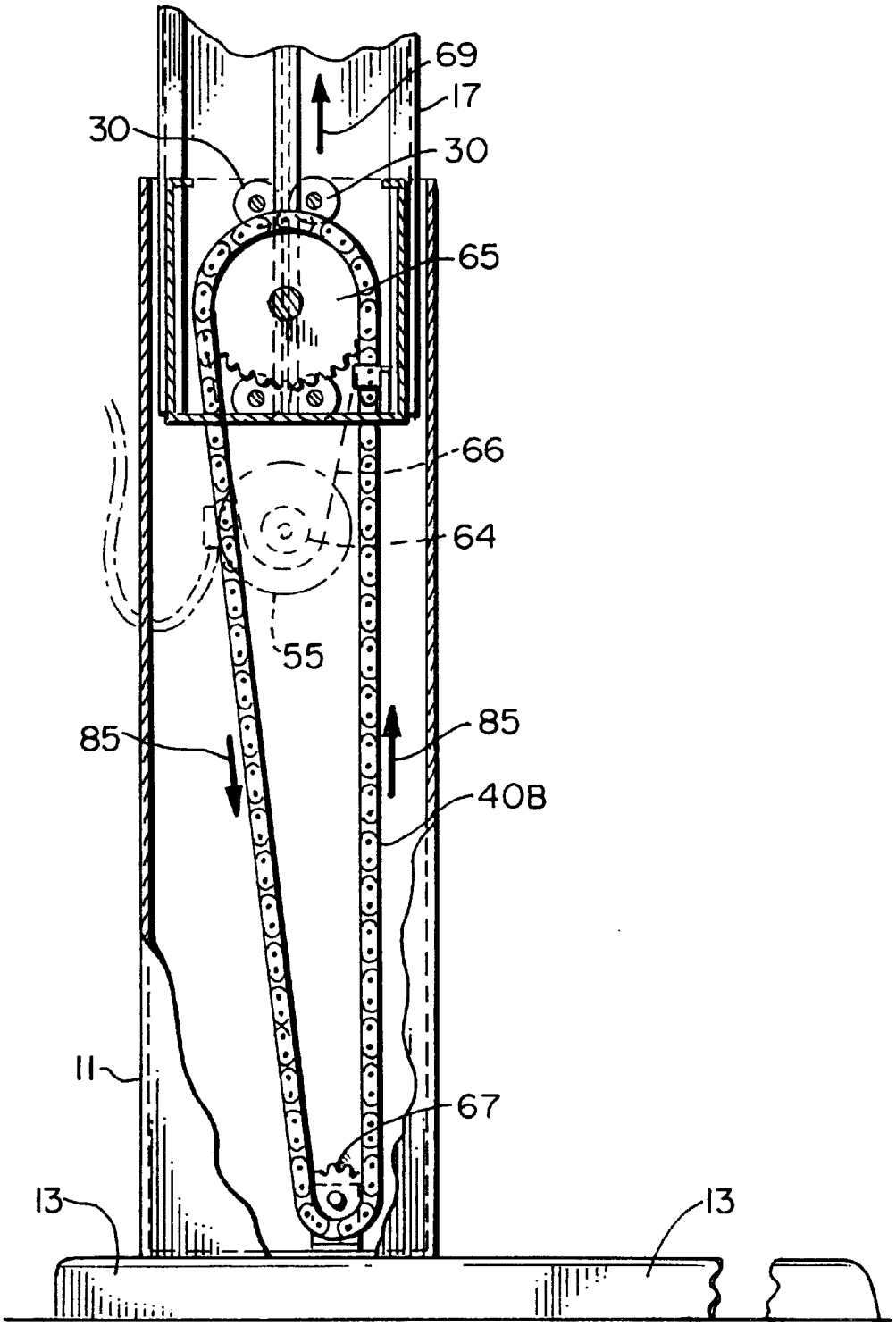
FIG. 10 is a sectional view of the preferred embodiment of the apparatus of the present invention illustrating the table in an elevated position.

The lifts 17 are attached to and support a planar table member such as a wooden or synthetic table 18 having a flat planar work surface 19 thereon. The combination of frame 22, feet 12, 13 table 18 and a selected mechanism provide an improved, height adjustable table arrangement. Frame 22 is specially configured to accept one of a selected plurality of elevating mechanisms, providing a different set of holes in the base 11 for each different mechanism. These mechanisms can include a counterbalance torsion spring 21 as shown in FIGS. 1–4, an electric motor drive mechanism as shown in FIGS. 8–10, or a manually operable crank mechanism as shown in FIGS. 11–14. In FIGS. 1–4, the counterbalance spring mechanism 21 stores energy that assists a user in elevating or lowering tabletop 18 and the equipment that is contained on its flat planar work surface 19. The torsion spring mechanism 21 includes a shaft 20 that engages the lifts 17 through a gearing arrangement that will be described more fully hereinafter.

Central drive shaft 20 extends between sides 14, 15 and more particularly through the lower 16 portions thereof. The drive shaft 20 is wound with an adjustable torsion spring 21 that counter balances for weight changes on surface 19. The use of a torsion spring 21 as a counter balance mechanism is shown and described in the Amthor, et al. U.S. Pat. No. 3,273,517 which is incorporated herein by reference.

The adjustable torsion spring 21 enables the user to adjust the load placed upon work surface 19 of table top 18 when weight varies. For example, a user might use the table 10 to support a 30–50 pound computer and/or monitor on one day yet be required to use the same table with no weight at all on the work surface 19 on another day. Such a torsion spring arrangement enables the table to be adjusted so that it is easy for a user to raise or lower the table 18 notwithstanding the amount of weight placed upon upper surface 19 of table 18.

A brake mechanism (not shown) can be interfaced with upper sprocket 44 to adjustably compensate for overwound or underwound conditions of the spring 21 mechanism. Such a brake mechanism is shown and described in co-pending U.S. patent application Ser. No. 09/328,817 filed Jun. 9, 1999 and U.S. patent application Ser. No. 09/328,717 filed Jun. 9, 1999, both incorporated herein by reference.

Figure 3:
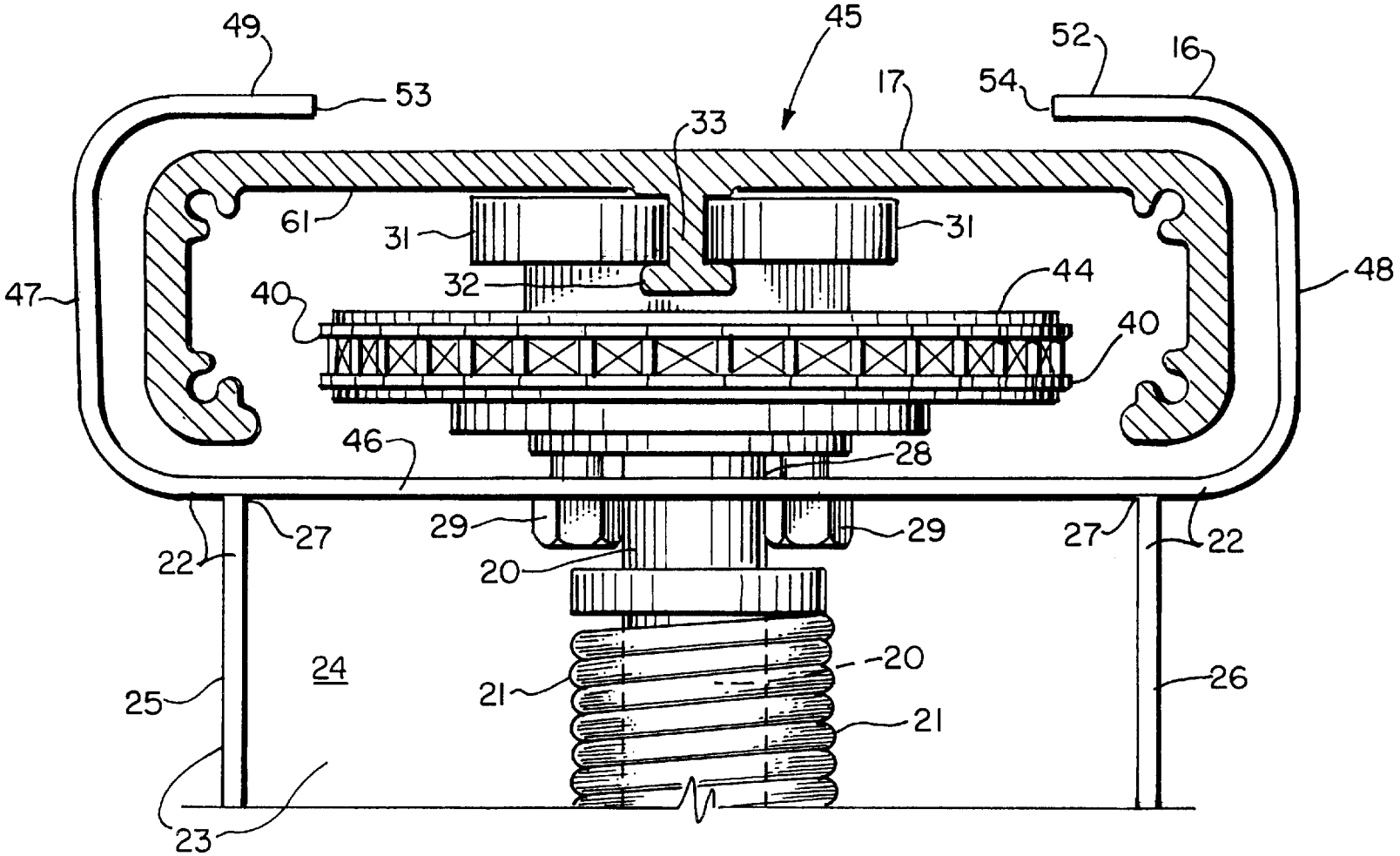
FIG. 3 a sectional view taken along lines 3—3 of FIG. 2.

Frame 22 includes the non-elevating lower portions 16 and a central horizontal tray 23. In FIG. 3, tray 23 includes bottom plate 24, front plate 25 and rear plate 26. The plates 24, 25, 26 can be an integrally formed U-shaped member. Tray 23 can be welded, for example, at welded connections 27 to each non-elevating lower portion 16. The lower end portion of each non-elevating portion 16 can provide attachments (eg. bolted or welded) for affixing a pair of feet 12, 13 to frame 22.

An opening 28 in each non-elevating lower portion 16 receives an end portion of shaft 20 as shown on FIG. 3. Bolted connections 29 can be used to affix a bushing, brake mechanism or the like to each end portion of shaft 20. Such a brake arrangement is shown more particularly in prior, co-pending patent application Ser. No. 09/328,817, filed Jun. 9, 1999.

Each non-elevating portion 16 has a vertical slot 45 that affords access to lift 17. Slot 16 can be covered with a removable panel (eg. plastic, metal, etc.). Each non-elevating portion 16 is thus comprised of vertical plate 46 and flanges 47, 48, 49, 52. Flanges 49, 52 are on opposing sides of slot 45, having respective vertical edges 53, 54.

Figure 4:
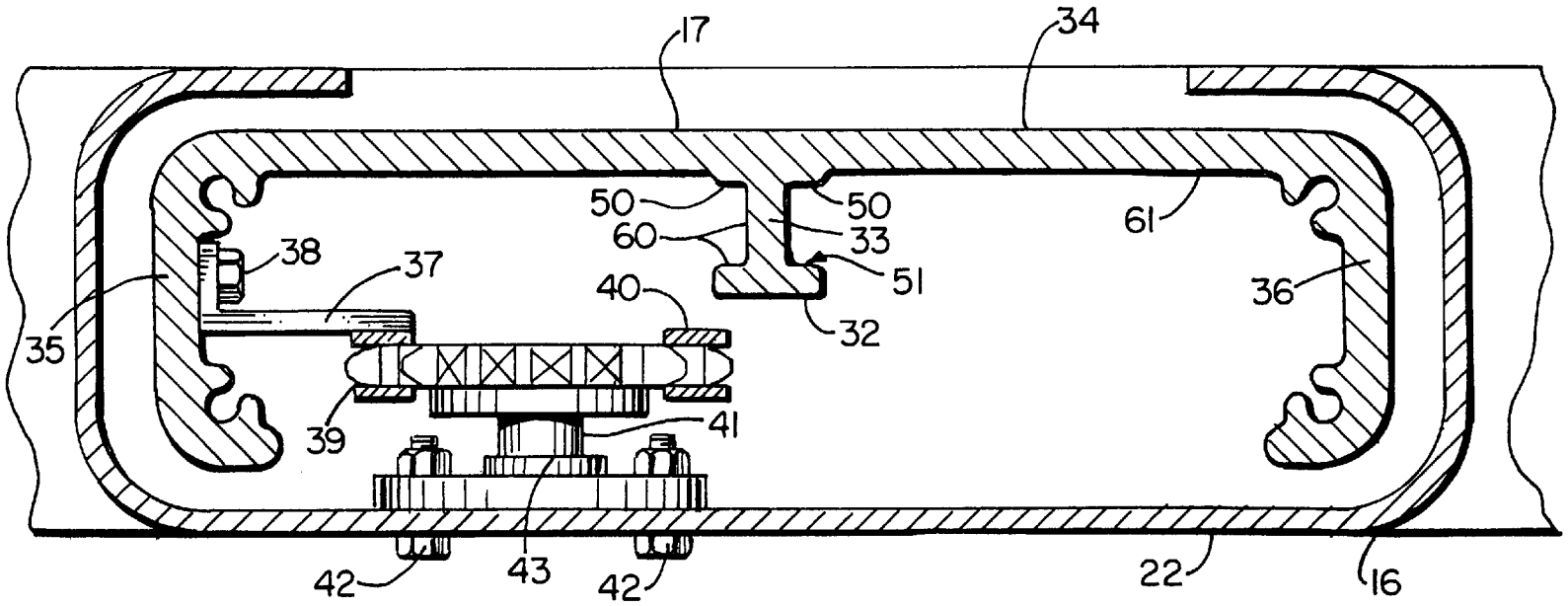
FIG. 4 a sectional view taken along lines 4—4 of FIG. 2.
Figure 5:
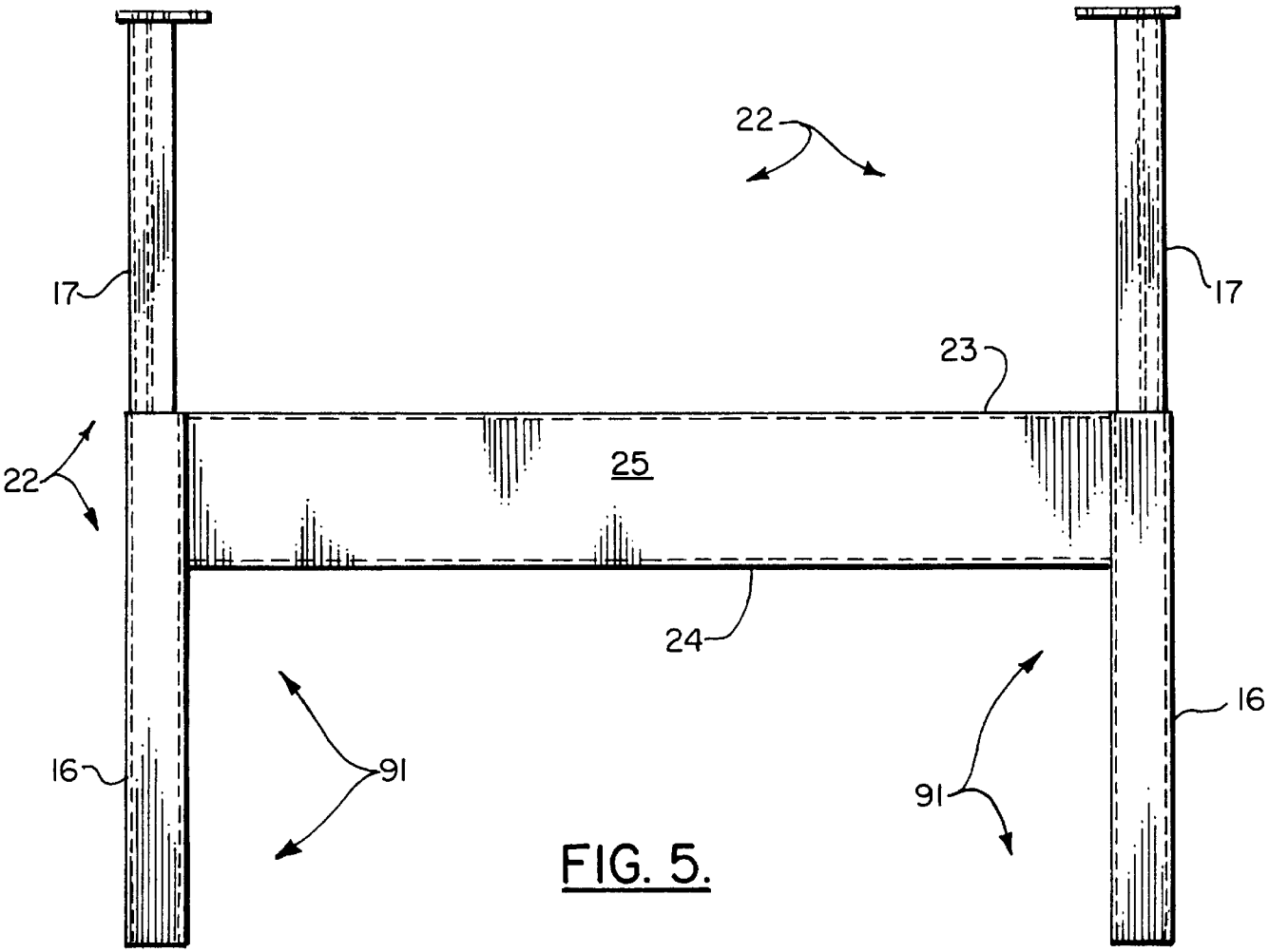
FIG. 5 is a fragmentary elevation view of the preferred embodiment of the apparatus of the present invention illustrating the frame.
Figure 7:
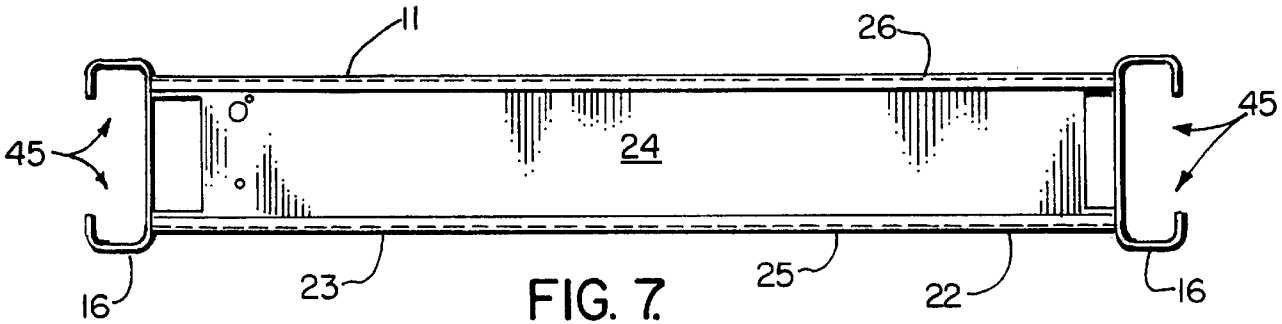
FIG. 7 is a fragmentary top view of the preferred embodiment of the apparatus of the present invention illustrating the base portion of the frame.
Figure 6:
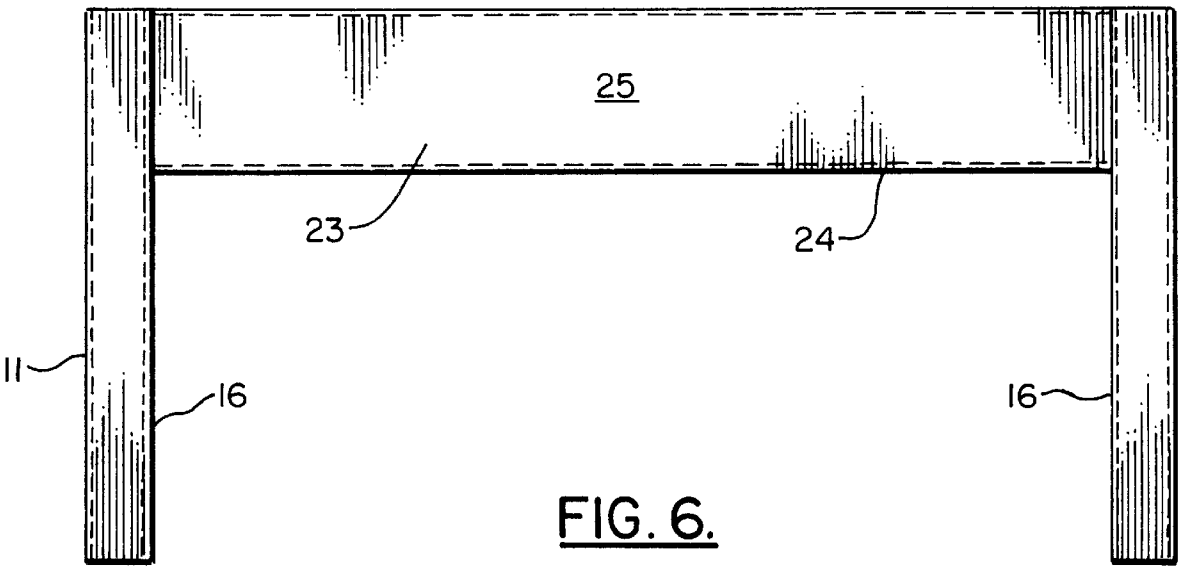
FIG. 6 is a fragmentary elevation view of the preferred embodiment of the apparatus of the present invention illustrating the base portion of the frame.

Each upper lift 17 is comprised of wide flange 34 and opposed flanges 35, 36 as shown on FIG. 4. An inside surface 61 of lift 17 has rail 60. Rail 60 is comprised of intersecting rail flanges 32, 33 as shown on FIG. 4. Rail 60 extends inwardly from flange 34 and is spaced about midway in-between flanges 35, 36.

A pair of spaced apart sprockets include lower sprocket 39 and upper sprocket 44. Chain 40 is an endless chain that engages both lower sprocket 39 and upper sprocket 44. Lower sprocket 39 is connected to frame 22 at non-elevating lower portion 16 using fasteners (eg. bolted connections) 42. A bearing 43 and shaft 41 attached to frame 22 can be used to support sprocket 39.

A plurality of rollers 31 are supported upon roller shafts 30 next to rail 60. Roller shafts 30 are attached (eg. welded) to the upper end of each non- elevating portion 16 of frame 22. Each roller 31 engages flange 33 of rail 60. Rail 60 acts as a retainer for holding elevating portion 17 in a fixed position relative to frame 22. The rollers 31 prevent translation of upper elevating portion 16 in both side to side and front to back directions. Rails 60 are mounted to inside surface 61 of each lift 17 and constrained from front to rear movement by rollers 31. The rollers 31 prevent side to side movement of upper elevating member 17, because the width of each roller is equal to the distance between surfaces 50, 51 of rail 60.

The frame 22 (see FIG. 5) is configured to receive a selected one of a plurality of available mechanisms. In FIGS. 8–10, an electric motor drive mechanism is shown for elevating the work table 18. Motor drive 55 is provided with power cord 56. The motor drive 55 is connected to shaft 57 with gearbox 66. The sprocket 65 on shaft portion 63 engages a long chain 40B which engages lower sprocket 67. In this fashion, rotation of the motor drive 55 and its shaft 64 provides a gearing arrangement with gearbox 66 that rotates shaft portion 63, sprocket 65, and thus sprocket 67 and chain 40B.

Shaft 57 is coupled to upper sprocket 65 as shown in FIGS. 8 and 9. A coupling 58 can be used to break shaft 57 into two shaft portions 57, 63 so that the motor drive 55 and its gear box 66 and/or sprocket 65 can be removed for maintenance purposes. Arrow 59 in FIG. 8 indicates that motor 55 is preferably a reversible motor so that shaft 57 can be rotated in either rotational direction. This enables the motor drive 55 to be operated in different rotational directions using rocker switch 68, for example, so that the chain 40B can be rotated in different rotational directions for either raising or lowering the tabletop 18.

Arrow 62 in FIG. 8 schematically indicates that tabletop 18 can be either elevated or lowered as selected by a user. In FIG. 10, arrow 69 schematically illustrates the elevating of lift 17 with respect to base 11 when chain 40B moves in the direction of arrows 85.

Figure 11:
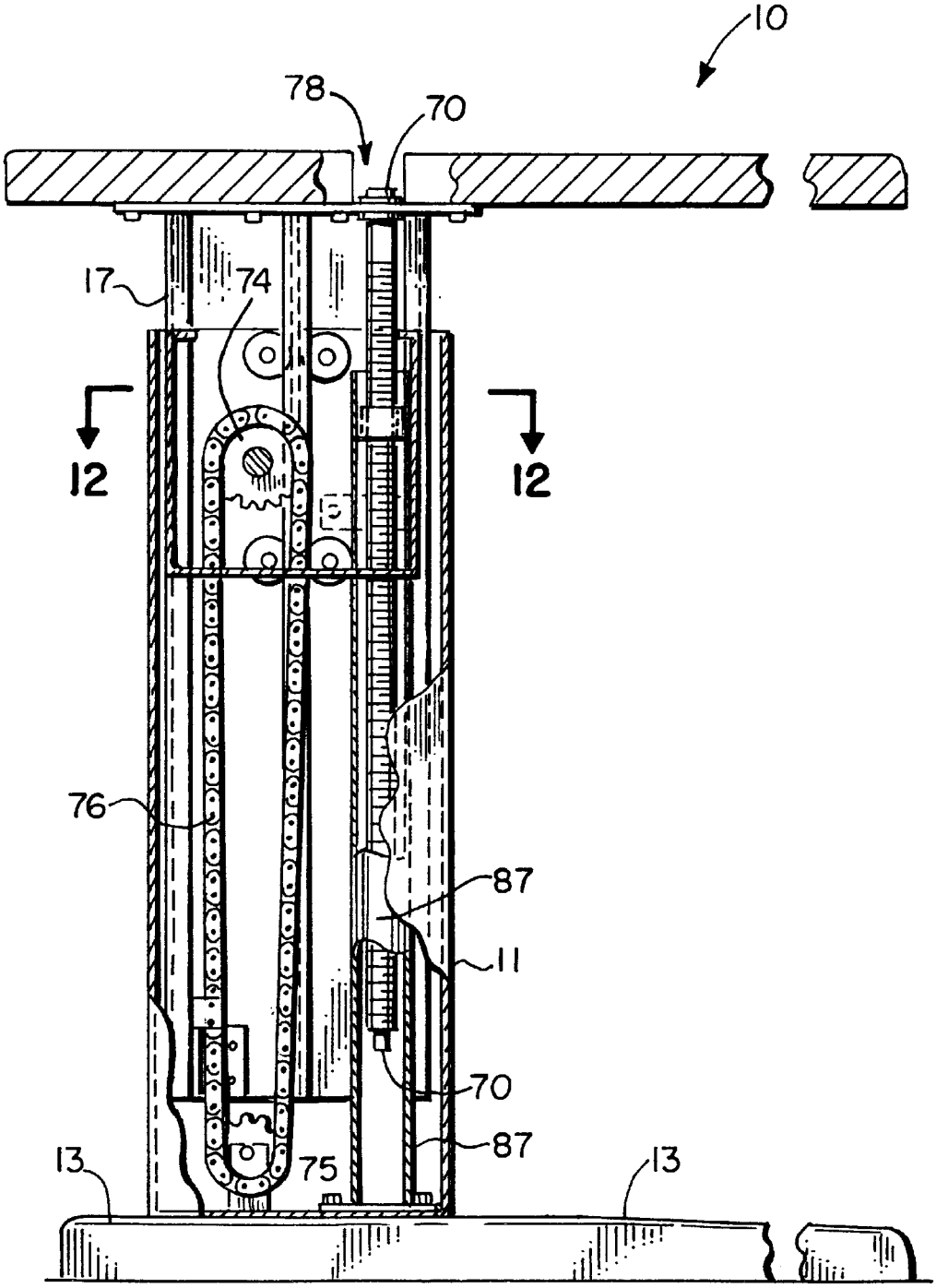
FIG. 11 is a sectional view of the preferred embodiment of the apparatus of the present invention equipped with a manually operable crank mechanism for elevating the table.
Figure 12:
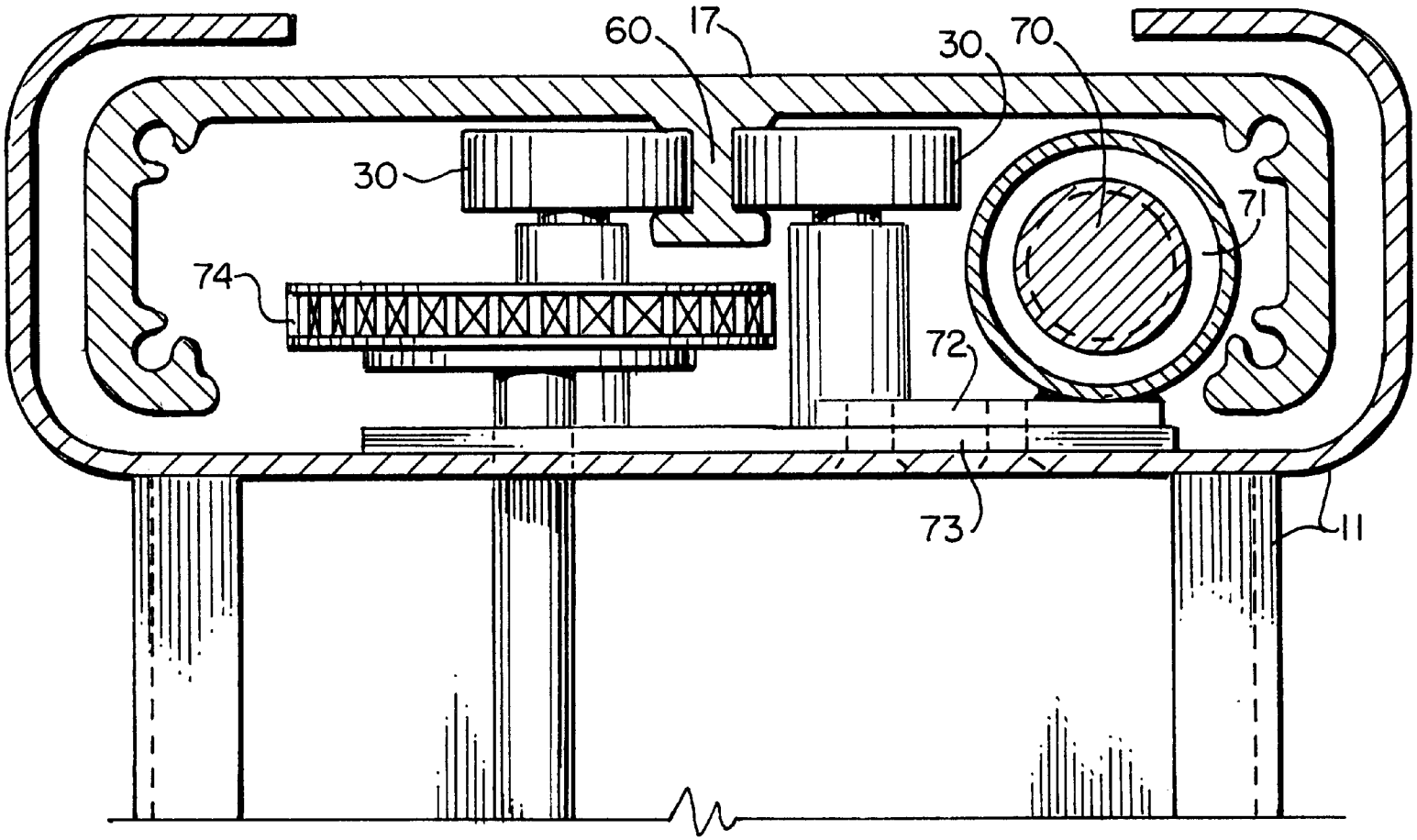
FIG. 12 is a sectional view taken along lines 12—12 of FIG. 11
Figure 13:
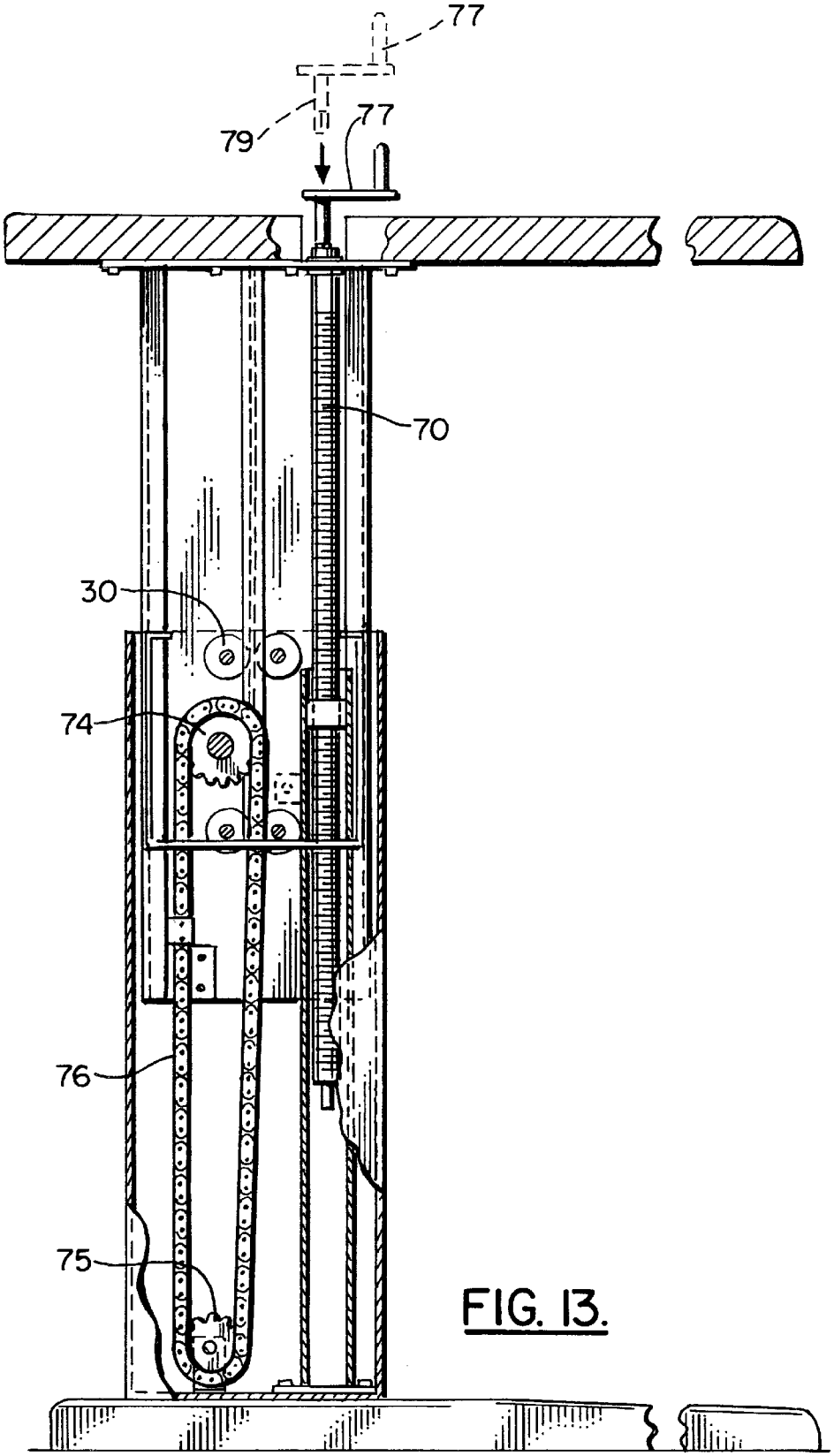
FIG. 13 is a sectional view of the preferred embodiment of the apparatus of the present invention equipped with a manually operable crank mechanism for elevating the table, showing the table in an elevated position.
Figure 14:
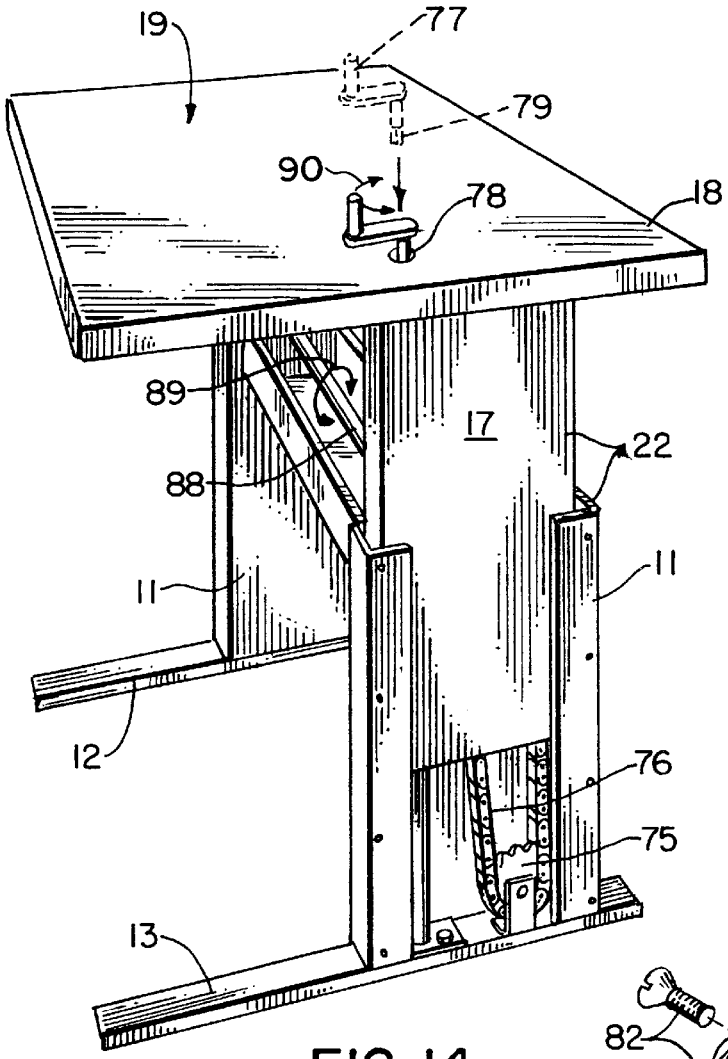
FIG. 14 is a perspective view of the preferred embodiment of the apparatus of the present invention equipped with a manually operable crank mechanism for elevating the table.

In FIGS. 11–15, the apparatus 10 of the present invention is shown with a manually operable crank mechanism. An elongated vertically oriented threaded rod 70 is attached at its upper end portion to tabletop 18, moving with lift 17 and tabletop 18 during use. The rod 70 engages a threaded nut 71 that is attached to non-elevating base 11 portion of frame 22 as shown in FIG. 12. The lower end portion of rod 70 can be mounted in a plastic sleeve that spaces the rod 70 from contacting the inside surface of the vertical channel 87. The rod 70 threadably engages nut 71 so that when the rod 70 is rotated, the table top 18 can be raised or lowered. In this fashion, rotation of the rod 70 causes each tube or lift 17 to elevate or lower. Because the rod 70 is only provided on one side of the apparatus 10, chains 76 and corresponding upper 74 and lower 75 sprockets are provided on both sides of frame 22 at each non-elevating portion 16 of base 11.

The upper sprockets 74 are connected with horizontal shaft 88 as shown in FIGS. 11–15. As indicated by the curved arrows 88 and 90 in FIG. 14, rotation of the crank 77 (see arrow 90) produces a corresponding rotation of the rod 88 as indicated by arrow 89. Mounting bracket 72 can be attached to non-elevating portion 11 by welding, for example, or using fasteners 73.

An opening 78 is provided in tabletop 18 as indicated in FIG. 11 for enabling a user to access the upper end portion of rod 70. This enables a user to engage the upper end of rod 70 with crank 77 and more particularly for engaging a tooled end portion 79 of crank 77 into a correspondingly shaped connecting portion at the top of rod 70 such as for example a hexagonal socket.

Figure 15:
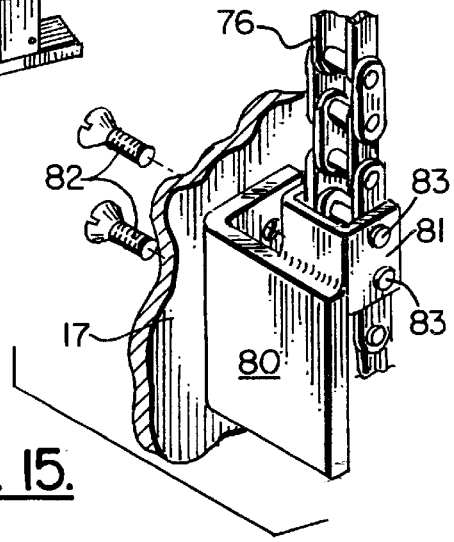
FIG. 15 is a fragmentary perspective view of the preferred embodiment of the apparatus of the present invention showing the chain bracket portion thereof.

Chain 76 forms a connection with the lower end portion of each lift 17 as shown in FIGS. 11 and 15. Chain bracket 80 is attached to lift 17 using fasteners 82 or other means such as welding. Chain bracket 80 includes channel member 81 that is connected using fasteners such as rivets 83 to chain 76.

The following is a list of suitable parts and materials for the various elements of the preferred embodiment of the present invention.

| PARTS LIST | |
|---|---|
| 10 | height adjustable table |
| 11 | base |
| 12 | foot |
| 13 | foot |
| 14 | side |
| 15 | side |
| 16 | non-elevating lower portion |
| 17 | lift |
| 18 | top |
| 19 | work surface |
| 20 | shaft |
| 21 | torsion spring |
| 22 | frame |
| 23 | tray |
| 24 | bottom plate |
| 25 | front plate |
| 26 | rear plate |
| 27 | weld |
| 28 | opening |
| 29 | bolted connection |
| 30 | roller shaft |
| 31 | roller |
| 32 | rail flange |
| 33 | rail flange |
| 34 | flange |
| 35 | flange |
| 36 | flange |
| 37 | bracket |
| 38 | fastener |
| 39 | lower sprocket |
| 40 | chain |
| 40A | chain |
| 40B | chain |
| 41 | shaft |
| 42 | fastener |
| 43 | bearing |
| 44 | upper sprocket |
| 45 | slot |
| 46 | vertical plate |
| 47 | flange |
| 48 | flange |
| 49 | flange |
| 50 | surface |
| 51 | surface |
| 52 | flange |
| 53 | edge |
| 54 | edge |
| 55 | motor drive |
| 56 | power cord |
| 57 | shaft |
| 58 | coupling |
| 59 | arrow |
| 60 | rail |
| 61 | inside surface |
| 62 | arrow |
| 63 | shaft |
| 64 | motor shaft |
| 65 | sprocket |
| 66 | gearbox |

-continued

| PARTS LIST | |
|---|---|
| 67 | sprocket |
| 68 | switch |
| 69 | arrow |
| 70 | rod |
| 71 | nut |
| 72 | mounting bracket |
| 73 | fastener |
| 74 | upper sprocket |
| 75 | lower sprocket |
| 76 | chain |
| 77 | crank |
| 78 | opening |
| 79 | tool end |
| 80 | chain bracket |
| 81 | channel |
| 82 | fastener |
| 83 | fastener |
| 84 | chain sprocket |
| 85 | arrow |
| 86 | sleeve |
| 87 | channel |
| 88 | horizontal shaft |
| 89 | arrow |
| 90 | arrow |
| 91 | knee area |

The foregoing embodiments are presented by way of example only; the scope of the present invention is to be limited only by the following claims.

What is claimed is:

1. An adjustable height table comprising:

a) a fixed base that includes spaced apart feet and spaced apart side portions, the side portions each having a cavity, a mounting surface, a generally horizontally extending cross brace member that connects the two fixed base side portions together by attachment to the mounting surfaces of the side portions and a vertical slot opposite the mounting surface;

b) a moving elevating portion that is mounted on the base, the elevating portion including a pair of spaced apart lifts, each lift telescopingly engaging a side portion at the side portion's cavity;

c) a lift mechanism interfacing the base and elevating portion for raising and lowering the elevating portion with respect to the base;

d) each lift having a vertical wall positioned next to the vertical slot of base side portion and an inner surface that faces inwardly toward the cross brace member, a vertically extending rail mounted on the inner surface that is configured to frictionally engage a roller; and e) a plurality of rollers mounted on the fixed base, interfacing the lifts and fixed base at the rail.

2. The adjustable height table of claim 1 wherein there are a pair of rail channels that each interface with a roller.

3. The adjustable height table of claim 1 wherein each rail has a generally tee shaped transverse cross section.

4. The adjustable height table of claim 1 wherein each rail has at least a pair of flanges.

5. The adjustable height table of claim 1 wherein each base side portion has an open side with a removable panel.

6. The adjustable height table of claim 1 wherein the base and elevating portions have multiple openings that enable different lift mechanisms to be selected from a plurality of lift mechanisms.

7. An adjustable height table comprising:

a) a base that includes spaced apart side portions that each have a mounting plate and a vertical slot opposite the mounting plate, the side portions connected by a horizontally positioned member at a point of attachment that is on an inside surface of the side portion at a mounting plate, the side portions each having a cavity, the vertical slots of each side portion being opposite the points of attachment of the tray to the respective side portions;

b) an elevating portion that is mounted on the base, the elevating portion including a pair of spaced apart lifts that telescopingly engage the respective base side portions, and a work surface each lift having a vertical slot;

c) a table top attached to the lifts, the table top having a work surface;

d) the lifts being movable vertically so that the elevation of the work surface can be raised and lowered with respect to the base;

e) a plurality of rollers, each mounted to a mounting plate at the vertical slot of a lift and within a cavity of a side portion, each roller shaped to frictionally engage a lift.

8. The adjustable height table of claim 7 wherein the base and elevating portions have multiple openings that enable different lift mechanisms to be selected from a plurality of lift mechanisms.

9. An adjustable height table comprising:

a) a base that includes spaced apart base side portions, a horizontal member that spans between the base side portions, the base side portions each having a side wall surrounding a cavity, a vertically extending slot in the sidewall, and a mounting plate being part of the sidewall;

b) an elevating portion that is mounted on the base, the elevating portion including a pair of spaced apart lifts that telescopingly engage a respective base side portions, and a table top with a work surface supported upon the lifts;

c) the lifts being movable vertically so that the elevation of the work surface can be raised and lowered with respect to the base;

d) a plurality of rollers each mounted within the cavity of a side portion to a mounting plate, a pair of rollers interfacing each base side portion with a lift; and e) each lift having a rail with opposed surfaces that are positioned to engage a roller.

10. The adjustable height table of claim 9 further comprising a powered mechanism for assisting a user to elevate or lower the lifts and work surface relative to the base.

11. The adjustable height table of claim 10 wherein the powered mechanism is a torsion spring.

12. The adjustable height table of claim 10 wherein the powered mechanism includes a motor drive.

13. The adjustable height table of claim 10 wherein the powered mechanism is a manually powered crank mechanism.

14. The adjustable height table of claim 9 wherein the base and elevating portions have multiple openings that enable different lift mechanisms to be selected from a plurality of lift mechanisms.

15. An adjustable height table comprising:

a) a base that includes spaced apart non-elevating side portions that are spaced apart and connected together by a horizontal member, the side portions each having a wall that has a mounting surface to which the horizontal member attaches, a cavity, a slot in the wall that extends substantially the full height of the non-elevating side portions opposite the mounting surface, and a plurality of rollers;

b) elevating portions including a pair of spaced apart lifts that telescopingly engage the respective non-elevating side portions, each lift having a wall, a cavity, a vertical lift slot, and a vertical rail opposite the lift slot;

c) a gear mechanism for raising and lowering the elevating portion with respect to the base;

d) each rail being shaped to engage a plurality of said rollers.

16. The adjustable height table of claim 15 wherein there are a pair of rollers engaging each rail of a lift to interface each elevating portion with the base.

17. The adjustable height table of claim 15 further comprising a powered mechanism for assisting a user to elevate or lower the lifts and work surface relative to the base.

18. The adjustable height table of claim 17 wherein the powered mechanism is a torsion spring.

19. The adjustable height table of claim 17 wherein the powered mechanism includes a motor drive.

20. The adjustable height table of claim 17 wherein the powered mechanism is a manually powered crank mechanism.

21. The adjustable height table of claim 15 wherein the base and elevating portions have multiple openings that enable different lift mechanisms to be selected from a plurality of lift mechanisms.

22. An adjustable height table comprising:

a) a non-elevating base that includes spaced apart side portions that are connected to a central horizontal member, the side portions each having a wall with a vertical slot that is generally opposite the horizontal member and each side portion having a cavity;

b) an elevating portion that is mounted on the base, the elevating portion including a pair of spaced apart lifts that telescopingly engage the respective base side portions, and a table top having a work surface, the table top being attached to the lifts;

c) the lifts being movable vertically so that the elevation of the work surface can be raised and lowered with respect to the base, each lift having a lift wall with a vertical lift slot that faces inwardly toward the horizontal member, and a rail that is generally opposite a lift slot;

d) a plurality of rollers, each mounted upon and within a cavity of a side portion, each roller engaging a rail; and e) a powered mechanism that interfaces each elevating portion with the base, the powered mechanism including a shaft contoured within the horizontal member and that extends into each side portion cavity.

23. The adjustable height table of claim 22 further comprising a powered mechanism for assisting a user to elevate or lower the lifts and work surface relative to the base.

24. The adjustable height table of claim 23 wherein the powered mechanism is a torsion spring.

25. The adjustable height table of claim 23 wherein the powered mechanism includes a motor drive.

26. The adjustable height table of claim 23 wherein the powered mechanism is a manually powered crank mechanism.

27. The adjustable height table of claim 22 wherein the base and elevating portions have multiple openings that enable different lift mechanisms to be selected from a plurality of lift mechanisms.

* * * * *